US006688966B2

(12) United States Patent
Akhtar

(10) Patent No.: US 6,688,966 B2
(45) Date of Patent: Feb. 10, 2004

(54) AIR HANDLING UNIT WITH SUPPLY AND EXHAUST FANS

(75) Inventor: Salman Akhtar, Mississauga (CA)

(73) Assignee: M & I Heat Transfer Products Ltd., Mississauga (CA)

( * ) Notice: Subject to any disclaimer, the term of this patent is extended or adjusted under 35 U.S.C. 154(b) by 49 days.

(21) Appl. No.: 10/127,865

(22) Filed: Apr. 23, 2002

(65) Prior Publication Data

US 2003/0199245 A1 Oct. 23, 2003

(51) Int. Cl.[7] ..... F24F 1/02

(52) U.S. Cl. ..... 454/235; 62/296; 62/DIG. 16; 165/249

(58) Field of Search ..... 454/228, 229, 454/234, 235, 236, 262, 265, 266, 267, 268, 269; 165/249; 62/296, DIG. 16

(56) References Cited

U.S. PATENT DOCUMENTS

| | | | | |
|---|---|---|---|---|
| 2,004,927 A | | 9/1935 | Bulkeley | |
| 3,212,424 A | | 10/1965 | Davis | |
| 3,405,758 A | * | 10/1968 | Wythe et al. | 165/249 |
| 3,717,080 A | | 2/1973 | Foty | |
| 3,973,590 A | | 8/1976 | Logsdon | |
| 4,018,266 A | * | 4/1977 | Kay | 165/237 |
| 4,086,781 A | * | 5/1978 | Brody et al. | 62/180 |
| 4,287,962 A | | 9/1981 | Ingard et al. | |
| 4,605,160 A | | 8/1986 | Day | |
| 4,836,096 A | * | 6/1989 | Avery | 454/238 |
| 5,522,768 A | * | 6/1996 | Brodt et al. | 454/234 |
| 5,632,675 A | | 5/1997 | Kanninen et al. | |
| 5,791,408 A | | 8/1998 | Seem | |
| 5,869,792 A | | 2/1999 | Allen et al. | |
| 6,099,405 A | * | 8/2000 | Cunningham, Jr. | 454/228 |

* cited by examiner

*Primary Examiner*—Harold Joyce
(74) *Attorney, Agent, or Firm*—Young & Basile P.C.

(57) ABSTRACT

An air handling apparatus for blending outside and return airflow including a housing having exterior side walls, a top and a bottom and containing first and second inlet regions and a mixing chamber. Outside air flows through a first inlet into the first inlet region while return air flows through another inlet into the second inlet region. There are also first and second damper mechanisms positioned between the first and second inlet regions and the mixing chamber, each capable of adjusting the amount of airflow from the respective inlet region to the mixing chamber. An exhaust fan is mounted on the housing above the second inlet region while an air supply fan is mounted in the housing on the downstream side of the mixing chamber. Heating and cooling coil units can be located downstream of the mixing chamber.

23 Claims, 6 Drawing Sheets

AIR HANDLING UNIT WITH SUPPLY AND EXHAUST FANS

BACKGROUND OF THE INVENTION

This invention relates to air handling systems in particular devices and apparatus for blending separate airflows, for example an outside airflow and a return airflow.

A wide variety of air handling systems has been developed for providing fresh air and/or conditioned air to a building which can either be a large building having many stories or a smaller structure. Usually these air handling systems involve the use of one or more fan units to supply air to the building and also to exhaust air to atmosphere. Because of the noise that these fans create, which noise can sometimes pass through air duct systems, silencer devices have also been developed for air handling systems.

In an air handling system, it is often desirable or necessary to mix fresh air which generally comes from outside atmosphere with return air, that is air that is being drawn back from the interior of the building itself. The amount of fresh air or outside air that is used at any given time in an air handling system will often depend on outside weather conditions including particularly the temperature of the outside air. If for example the outside air is close to the desired temperature for room air within the building, then generally speaking more outside air can and will be introduced or used in the system, resulting in fresher air being circulated to the rooms of the building. However if the outside air is considerably colder or considerably warmer than the desired indoor room temperature, it will generally be desirable to use a greater amount of return air in the air handling system as this will result in greater economy and less demands on the heating or cooling systems of the building.

Recent U.S. Pat. No. 5,587,563 issued Dec. 24, 1996 to Yazici et al. describes an air handling system suitable for a larger building, this system including an axial fan unit mounted between inlet and outside silencers. This known system is mounted in a typical equipment room for the building and to this room can be connected inlets which supply air to the room and to the air supply equipment including the fan. Air enters the inlet silencer and is then blown by the fan through the outlet silencer which is connected to a bank of air filters. The air passes through these filters to a rectangular plenum from which the air can be taken by means of supply ducts.

In another known conventional system, the air supply equipment for the building can be mounted in an enclosed housing which can include relatively large and similar return air and supply air fans mounted within the housing and in opposite end sections thereof. The return air fan can draw return air into the housing through an inlet at one end thereof and then this return air can be exhausted to atmosphere to the desired extent or it can be passed to a central mixing chamber where outside air can be introduced through another inlet. The mixed air in this central chamber is then drawn by the supply fan through heat exchanging coil units and a filter bank and blown by the fan through an outlet located adjacent to one end of the housing. One difficulty with this conventional system however is that it must be quite long to accommodate both the supply and return air fan units in the housing and due to the need for a relatively large mixing chamber.

Another known air handling system is that taught in U.S. Pat. No. 4,605,160 issued Aug. 12, 1986 to J. L. Day. This system is mounted in a casing or housing with an axial air supply fan mounted at one end of the housing adjacent to an outlet duct. An internal partition divides the inlet end of the casing into two compartments into one of which outside air flows through one inlet and into the other of which flows return air through another inlet located in the side of the casing. Airflow from the two compartments is controlled by means of two pivoting dampers in the form of gates that extend into an air mixing region. Heat transfer coils are located on the downstream side of this air mixing region and these coils extend across the casing. The two gates can be made of insulating material and may be provided with gaskets so that they can form a seal when they are closed. One difficulty with this known system is that there is no apparent provision for exhausting return air to atmosphere after it enters the housing and before it enters into the mixing region. Another difficulty is that because only two pivoting gate dampers are used, a good mixing of the two air flows cannot be achieved before the air passes through the heat exchanging coils. This can result in inefficient use of the heat exchanging coils and also possible stratification of the air flows and coil freeze ups.

It is an object of the present invention to provide an air handling apparatus capable of blending separate airflows in an efficient manner and in a manner which does not require an excessive amount of space for the apparatus It is a further object of the present invention to provide an air handling apparatus which is relatively inexpensive to construct and maintain and which includes both an air supply fan mounted in a housing downstream of a mixing chamber and an exhaust fan unit that is capable of exhausting a substantial portion of the return air flow, preferably up to 100% of the return air, to atmosphere.

SUMMARY OF THE INVENTION

According to one aspect of the invention an air handling apparatus for blending and conditioning separate airflows includes a housing having exterior sidewalls, a top and a bottom, and containing an interior space that includes first and second inlet chambers, an air mixing chamber, and a fan containing chamber, this housing also having a first inlet for a primary airflow opening into the first inlet chamber, a second inlet for return airflow opening into the second inlet chamber, and an air outlet connected to the fan containing chamber. There is an internal partition mounted in the housing and separating the first and second inlet chambers. A heat exchanging coil unit is mounted in the housing on a downstream side of the air mixing chamber opposite the first and second inlet chambers. A first multi-blade damper mechanism is positioned between the first inlet chamber and the air mixing chamber and is capable of adjusting the amount of the primary airflow passing from the first inlet chamber into the air mixing chamber. A second multi-blade damper mechanism is positioned between the second inlet chamber and the air mixing chamber and is capable of adjusting the amount of the return air flow passing from the second inlet chamber into the air mixing chamber. There are also provided an exhaust fan unit operatively connected to the housing and capable of removing the return air flow from the second inlet chamber and an air supply fan unit mounted in the fan-containing chamber and adapted to deliver air from the air mixing chamber to the air outlet. The first and second damper mechanisms are located at an end of the partition and are mounted on opposite sides of the partition.

Preferably the exhaust fan unit is mounted directly on top of the housing above the second inlet chamber.

According to another aspect of the invention, an air handling apparatus for blending separate airflows includes a housing having exterior or external side walls, a top and a bottom and containing an interior space having first and second inlet regions and a mixing chamber. The housing also has a first inlet for a primary airflow to pass into the first inlet region and a second inlet for a return air flow to pass into the second inlet region. There is also an air outlet located on a downstream side of the mixing chamber and away from the first and second inlet regions. An internal partition in the housing separates the first and second inlet regions. A first damper mechanism is positioned between the first inlet region and the mixing chamber and is capable of adjusting the amount of the primary airflow into the mixing chamber. This first damper mechanism comprises a first multi-blade damper and a first control mechanism for adjusting the position of the blades of the damper to open and close air gaps formed between the blades. There is also a second damper mechanism positioned between the second inlet region and the mixing chamber and capable of adjusting the amount of return air flow passing into the mixing chamber. The second damper mechanism comprises a second multi-blade damper and a second control mechanism for adjusting the position of the blades of the second damper to open and close air gaps formed between these blades. The apparatus also includes an exhaust fan unit operatively connected to the second inlet region at or near the top of the housing and selectively capable of exhausting at least a portion of the return air flow to atmosphere. Also an air supply fan unit is mounted in the housing of the downstream side of the mixing chamber and is capable of drawing air from the mixing chamber and delivering same to the air outlet.

In a preferred embodiment, the exhaust fan is mounted on top of the housing and the second inlet for the return air flow is located at a bottom end of the second inlet region. Preferably each of the first and second multi-blade dampers comprises a series of parallel, elongate damper blades with each blade having a longitudinal axis that extends substantially vertically.

According to a further aspect of the invention, an air handling apparatus for blending an outside airflow and a return airflow from a building or other structure includes a housing having two longitudinally extending sidewalls, two end walls, a top and a bottom and an air entrance section, an air mixing section and a fan section. The housing also has a first inlet for the outside airflow to enter one side of the air entrance section and a second inlet for return airflow to enter another side of the air entrance section, and an air outlet located in the fan section. First and second damper mechanisms are positioned between the air entrance section and the air mixing section and each of these damper mechanisms comprises a multi-blade damper and a control mechanism for adjusting the blade of each damper to open and close air gaps formed between the blades. The first damper mechanism is capable of controlling the outside airflow into the air mixing section and the second damper mechanism is capable of controlling the return airflow into the air mixing section. There are also provided an exhaust fan unit mounted on top of the housing above the air entrance section and selectively capable of exhausting at least a portion of the return airflow to the outside atmosphere and an air supply fan unit mounted in the fan section which is located on a side of the air mixing section opposite the air entrance section.

Preferably the side walls and the end walls of the housing are insulated with sound attenuating material. The preferred air entrance section is divided into an outside air chamber and a return air chamber by an interior partition extending from the bottom to the top of the housing.

Further features and advantages will become apparent from the following detailed description taken in conjunction with the accompanying drawings.

DETAILED DESCRIPTION OF PREFERRED EMBODIMENT

Figure 1:
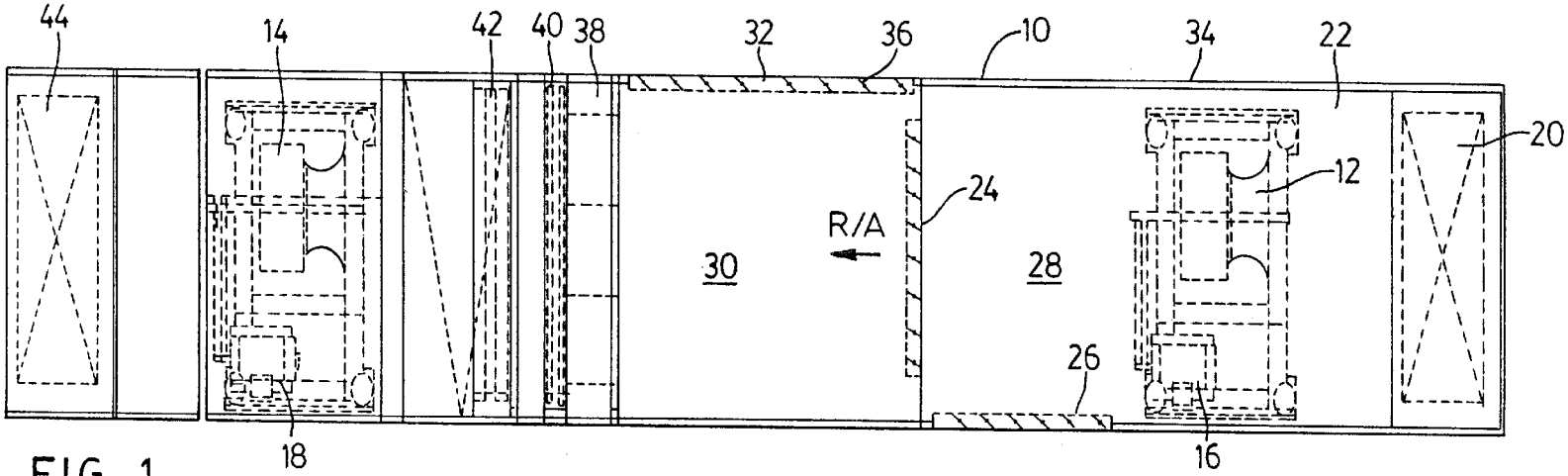
FIG. 1 (PRIOR ART)
FIG. 1 is a schematic plan view illustrating a conventional air handling system having both a return air centrifugal fan and a supply air centrifugal fan.

FIG. 1 of the drawings illustrates a conventional air handling system used to supply treated or conditioned air to a building. This conventional system has quite a long housing or room 10 which, in one embodiment for example measures over 35 feet in length and has a height of almost 8 feet. This housing can be mounted within or outside the building. In this housing there are mounted two relatively large, electrically operated fans which include a return air fan 12 and a supply air fan 14. The illustrated fans are both centrifugal fans powered by their own electrical motors 16 and 18. In one version of this system the return air fan has a capacity of 16,000 cfm and is driven by an electrical motor having a power of BHP 5.28 that operates at 918 RPM. The supply fan in this known system has a capacity of 20,000 cfm and motor 18 has a power rating of 22.13 BHP and operates at 1228 RPM Return air enters the housing 10 through an inlet 20 which can be formed in a floor 22 of the housing. It will be understood that inlet 20 is connected to the return air ducts of the building or structure. The return air that is being drawn into the housing by the fan 12 is able to pass through either or both of two separate openings indicated at 24 and 26. The passage of the return air through these openings is controlled by dampers mounted in the openings and these dampers can take form of elongate, parallel blades that are pivotably mounted and that are distributed evenly across the opening. One set of blades or louvers extends vertically and controls the passage of return air from an intake chamber 28 to a central, air mixing chamber 30. The other set of louvers controls the passage of the return air through the exhaust air opening 26.

In order to provide fresh air to the air supply system, outside air can enter the housing 10 through outdoor air inlet 32 which can, as shown, be mounted in a sidewall 34 of the housing. Again the amount of outdoor air is controlled by means of a set of parallel blades or louvers 36 which extend vertically. It will be understood that a control system is provided and is capable of operating the louvers or blades in the openings 24, 26 and 32 in order to adjust the proportion of return air and outdoor air that flows into the air mixing chamber 30. The air mixture in the chamber 30 is then drawn through a filter bank 38 and through heat exchanging coils which can include a heating coil unit 40 and a cooling coil unit 42. The mixed air is pulled from the chamber 30 by means of the supply air fan 14 and then the conditioned air exits the housing through an air outlet 44 at the downstream end of the housing 10. As illustrated this outlet 44 is in the bottom of the housing but the outlet could also be provided in the roof or a sidewall of the housing, if required. It will be appreciated that, although this known air supply system works satisfactorily, it does take up a lot of space, particularly in the longitudinal direction and often the space available in or on a building for such air supply equipment is limited and it may not be able to accommodate the space that is required by this conventional air handling system.

Figure 2:
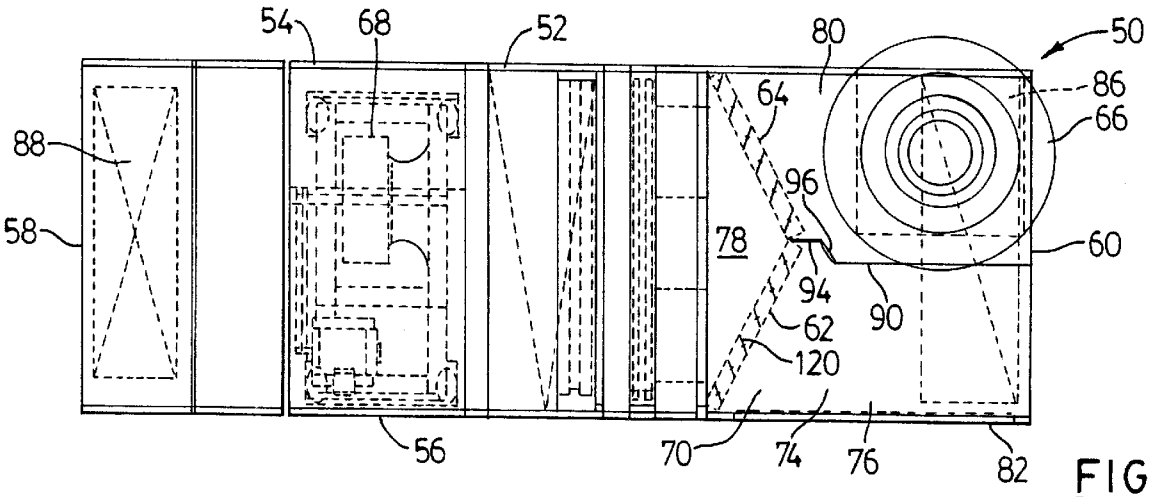
FIG. 2 is a schematic plan view similar to FIG. 1 but illustrating an air handling apparatus constructed in accordance with the invention.

One preferred embodiment of the air handling system of the present invention is illustrated in FIG. 2 and it will be seen by comparing FIGS. 1 and 2 that the air handling system of the present invention requires substantially less space at least in the longitudinal direction. For example the illustrated preferred embodiment shown in FIG. 2 can have an overall length of only 21 feet thus reducing the length of the apparatus by almost 15 feet compared to a conventional system constructed in accordance with FIG. 1 having a length of 35 feet 8 inches. The illustrated air handling apparatus 50, like the conventional system of FIG. 1, is capable of blending separate air flows, for example return air and outside air in order to supply a mixture of these two air flows back to the interior space in a building requiring conditioned air. Major components of the air handling apparatus 50 include a housing 52 having two longitudinal exterior side walls 54 and 56 and two exterior end walls 58 and 60, a first damper mechanism 62, a second damper mechanism 64, an exhaust fan unit 66, and an air supply fan unit 68.

Turning to the construction of the preferred housing 52, this housing forms an interior space 70 bounded by the exterior walls 54 to 60 and a top or roof 72 (see FIGS. 3 and 4), and a bottom or base 74. The interior space 70 includes first and second inlet regions 76 and 80 (which together form a divided air entrance section) and a mixing chamber 78. First damper mechanism 62 is positioned between the first inlet region 76 and the mixing chamber 78 and is capable of adjusting the amount of the outdoor air flow or the primary air flow passing into the mixing chamber. The second damper mechanism 64 is positioned between the second inlet region 80 and the mixing chamber and is capable of adjusting the amount of return airflow passing into the mixing chamber.

Figure 9:
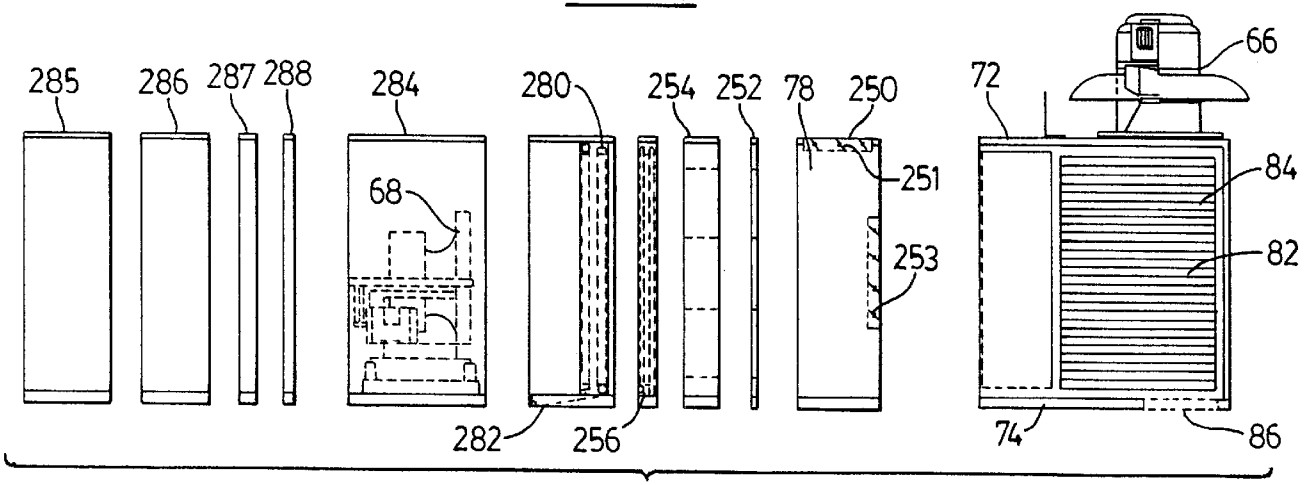
FIG. 9 is a blown-apart elevational view showing the same separate components and sections that are shown in FIG. 8.

The preferred housing 52 also has a first inlet 82 for the primary or outdoor airflow to pass into the first inlet region 76. As illustrated, this first inlet is located in the longitudinal sidewall 56 adjacent one end thereof. The inlet 82 can be rectangular and, as illustrated in FIG. 9, can extend most of the height of the housing. The inlet opening can be covered with a grillwork 84 which can, as illustrated, comprise a series of parallel, horizontal, metal or plastic vanes. This grillwork helps to prevent unwanted entry of items or objects through the inlet. Also it should be appreciated that if the apparatus 50 is to be located outdoors the housing 52 will be exposed to the elements and the grillwork helps to keep rain, snow, etc. from entering the housing. Typically the air handling apparatus 50 of the invention can be mounted on the roof of the building to which it is supplying conditioned air. Alternatively, or in addition, the air inlet 82 can be arranged in the end wall 60 so as to open into the inlet region 76.

The housing is also provided with a second inlet 86 for return airflow to pass into the second inlet region 80. In the illustrated preferred embodiment, this second inlet is located in the bottom of the housing which is a convenient location for this inlet if the air handing apparatus 50 is mounted on a roof top. It will be understood that the return air duct in the building is connected to this second inlet 86 so that the returned air can be drawn into the inlet region 80. The housing also has an air outlet 88 located on a downstream side of the mixing chamber 78 and away from the first and second inlet regions. As illustrated in FIG. 2, this air outlet is at the left hand end of the housing and is located in the floor or bottom 74 thereof. Again it will be understood that this outlet is connected to the supply air duct work of the building so that the air handling apparatus 50 can supply the required conditioned air (which may be heated or cooled) to the building. It should also be noted that the housing has an internal partition or interior wall indicated generally by 90 which separates the first and second inlet regions or chambers 76,80. The illustrated preferred internal partition includes an interior wall or wall section 92 that extends substantially from the bottom 74 of the housing to the top 72 of the housing and that slopes upwardly and towards the second inlet region 80. The internal partition 90 can also include a vertical wall section 94 that extends from the floor of the housing to the top thereof. There is also a tapering connecting wall section 96 that joins the vertical wall section 94 to the sloping interior wall 92. Preferably the entire internal partition 90 including the interior wall 92 are insulated with sound attenuating material indicated at 98 in FIG. 11. Also the preferred internal partition has a perforated sheet metal skin on the side thereof that faces the second inlet region 80. This perforated sheet metal skin is indicated at 100 in FIG. 11. It is also possible for at least a portion of the sheet metal exterior on the opposite side of the internal partition to be perforated, for example the surface of the vertical wall section 94 can be perforated, if desired. However preferably the exterior sheet metal on surface 102 of the sloping interior wall 92 is imperforate. The sound attenuating material between the sheet metal exteriors can be compressed fibreglass batting, the use of which is well known in the air handling art for sound attenuation purposes. In one preferred embodiment of the invention, the thickness of the insulating material is about 2 inches.

Figure 3:
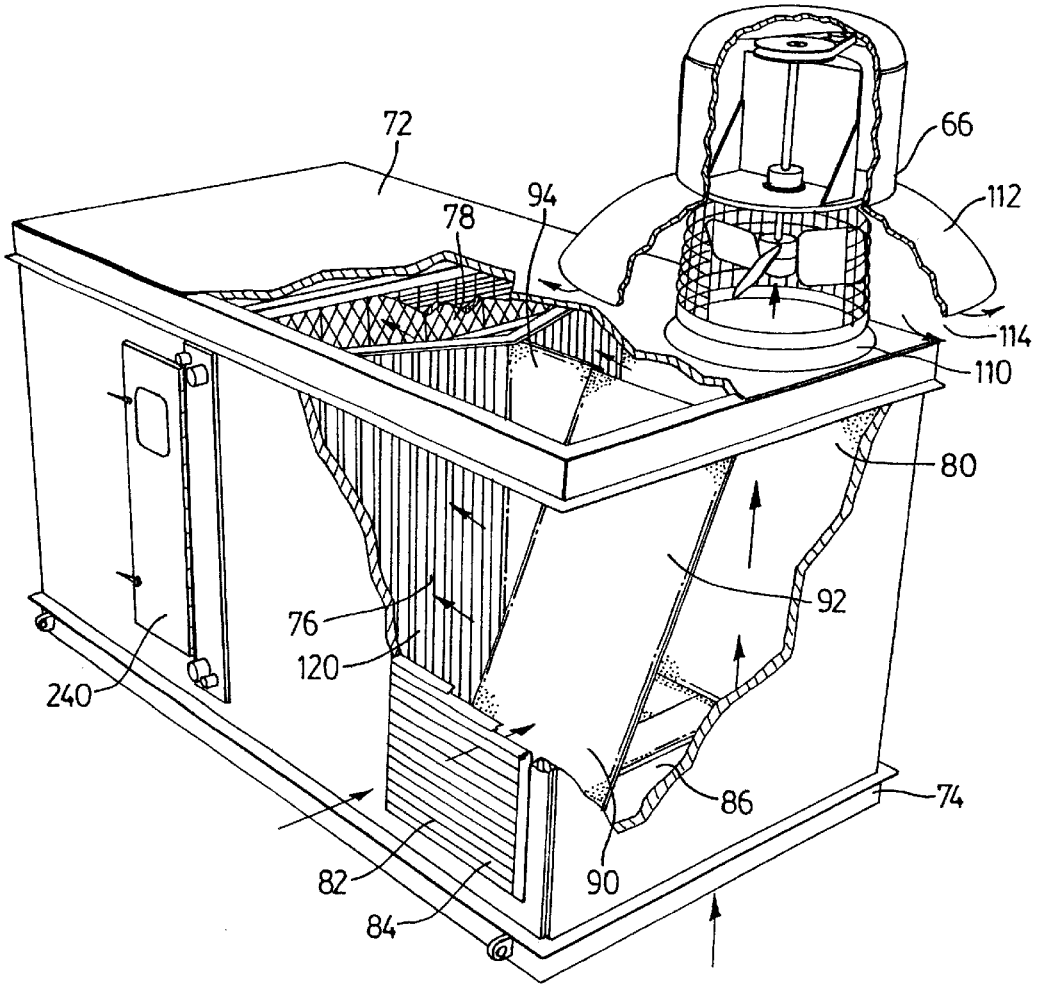
FIG. 3 is a schematic perspective view of one preferred embodiment of the air handling apparatus, this view being taken from above and from one end and having wall sections cut away for sake of illustration.

The aforementioned exhaust fan unit 66 is preferably mounted on the top 72 of the housing and thus is directly above the second inlet 86 for the return air as illustrated in FIG. 2. The fan unit 66 is located directly above the second inlet region or chamber 80. A preferred form of the exhaust fan 66 has a capacity of 16,000 cfm and it is driven by an electrical motor rated at 7.5 BHP. The exhaust fan can be an axial fan as illustrated in FIG. 3 and it can be mounted above a circular aperture 110 formed in the top 72 of the housing. The fan unit can be provided with an outwardly extending skirt 112 if the apparatus 50 is a roof mounted unit that is exposed to the elements. The skirt helps to prevent rain and snow from entering into the housing through the aperture 110. Exhaust air can pass out from under the skirt through an annular gap 114 formed between the bottom of the skirt and the top of the housing. The exhaust fan unit per se can be of standard construction and accordingly a detailed description herein is deemed unnecessary. It should be noted however that the preferred exhaust fan unit as illustrated requires a reasonable amount of room for mounting purposes and can, for example, cover an area extending about 4 feet by 4 feet. Accordingly the inlet region 80 is required to be of reasonable size in its horizontal dimensions in order to accommodate the exhaust fan when the latter is mounted directly above it. It will also be appreciated that the exhaust fan 66 is preferably sized so as to enable it to exhaust all of the return air to atmosphere for those situations and conditions where it is desired not to recirculate any of the return air but only to supply fresh air or outside air to the building. In this situation, the second damper mechanism 64 is closed as explained further hereinafter. Also with the use of this exhaust fan the user of the building has the option of flushing the building of its internal air either at peek occupancy or at desired intervals. Generally a portion of the return air, and even up to 100 per cent is exhausted by means of the exhaust fan so that it can be replaced by fresh outdoor air.

The preferred construction of the first and second damper mechanism 62 and 64 will now be described. It will be understood that these two damper mechanisms can generally be constructed in a similar manner. Accordingly the following detailed construction of the first damper mechanism 62 also applies, where appropriate, to the construction of the second damper mechanism 64. Each of these damper mechanisms comprises a first multi-blade damper comprising a number of elongate, parallel blades or louvers indicated at 120. A first damper mechanism 62 also includes a first control mechanism indicated generally at 122 in FIG. 8 for adjusting the position of the blades of the damper to open and close air gaps 124 formed between the blades. There is also schematically illustrated in FIG. 8 a second control mechanism 126 for adjusting the position of the blade of the second damper mechanism 64. It will be understood that these control mechanisms per se can be of standard construction and accordingly a detailed description herein is deemed unnecessary. Each of these control mechanisms would include motor means such as an electrical motor for pivoting the damper blades of each mechanism in unison to the desired position. The motor means is connected by suitable wiring to an electrical controller which can, for example, be a microprocessor. It will be understood that the electrical controls for both the first control mechanism 122 and the second control mechanism 126 can be combined as a single electrical control unit, if desired. However the combined unit is still capable of operating the two sets of damper blades independently of each other.

Figure 11:
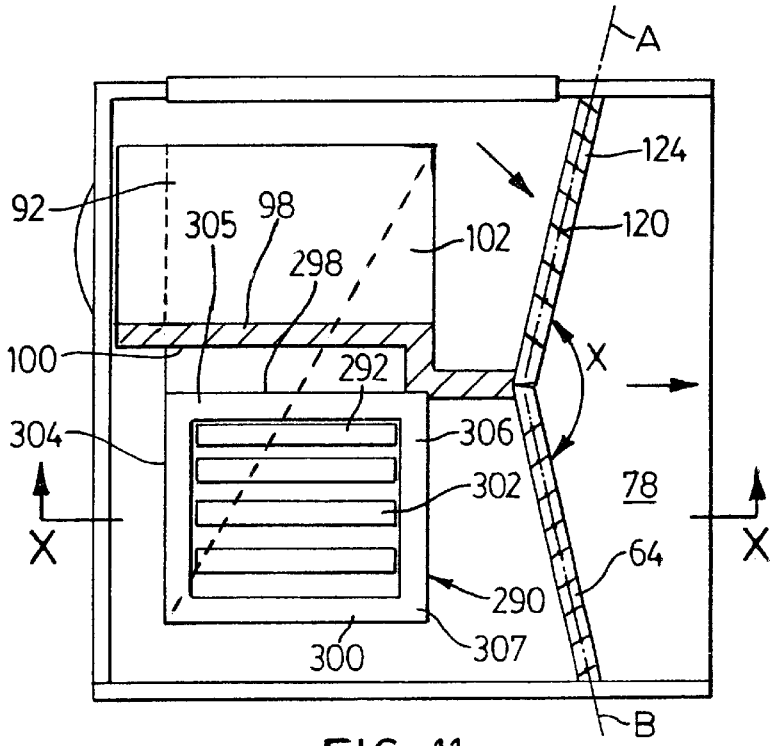
FIG. 11 is a horizontal cross-sectional view taken along the line XI—XI of FIG. 10 and showing the inlet silencer of FIG. 10 mounted in the inlet section of the housing.

As illustrated, the preferred multi-blade damper has a series of parallel, elongate damper blades which each blade 120 having a longitudinal axis extending along the center of the blade and extending substantially vertically. Also the first and second multi-blade dampers extend substantially in first and second vertical planes respectively when the air gaps 124 between their respective blades are closed. In FIG. 11, these vertical planes are indicated by the dash lines at A and B. Preferably the first vertical plane A extends at an obtuse angle X taken in a horizontal plane relative to the second vertical plane B. It will thus be seen that with the damper blades of each of the two mechanisms 62,64 in the partially opened position (as shown in FIG. 11), the two incoming airflows are directed at an angle towards one another and this causes a good mixing of the outside air and the return air in the mixing chamber 78. It will further be noted that this mixing can occur across the full height of the housing from its floor to the top 72 because the blades extend this full height. The aforementioned obtuse angle X faces toward the air mixing section or chamber 78 and it will be seen that this obtuse angle can vary to some extent with the angle being shown in FIG. 2, for example, being smaller than that shown in FIG. 11. Preferably, the obtuse angle X exceeds 120 degrees and most preferably this obtuse angle is at least 135 degrees.

It will be understood that the preferred blades of the two damper mechanisms are pivotable by means of their control mechanism about a vertical axis from a fully opened position (where the blades extend perpendicular to their respective vertical planes A and B) to a fully closed position where the blades of each damper mechanism extend substantially in the aforementioned vertical plane A or B. Under normal operating condition of the air handling apparatus, the blades of each damper mechanism are at least partially open to allow for both return air and outside air to be drawn through the filters and the coils by the supply fan. However under certain conditions the damper blades of either damper mechanism will be fully closed and the blades of the other damper mechanism can be fully open. For example, in order to save energy when the temperature outside is either very cold or very warm, the first damper mechanism may be fully closed (at least for short periods of time) to permit full use of return air which will be close to the desired room temperature. Alternatively under such conditions, the first damper mechanism 62 may be only open a small degree to permit a small amount of fresh air to be introduced into the building's air system while a large portion of the conditioned air being supplied by the supply fan to the building is return air.

Figure 4:
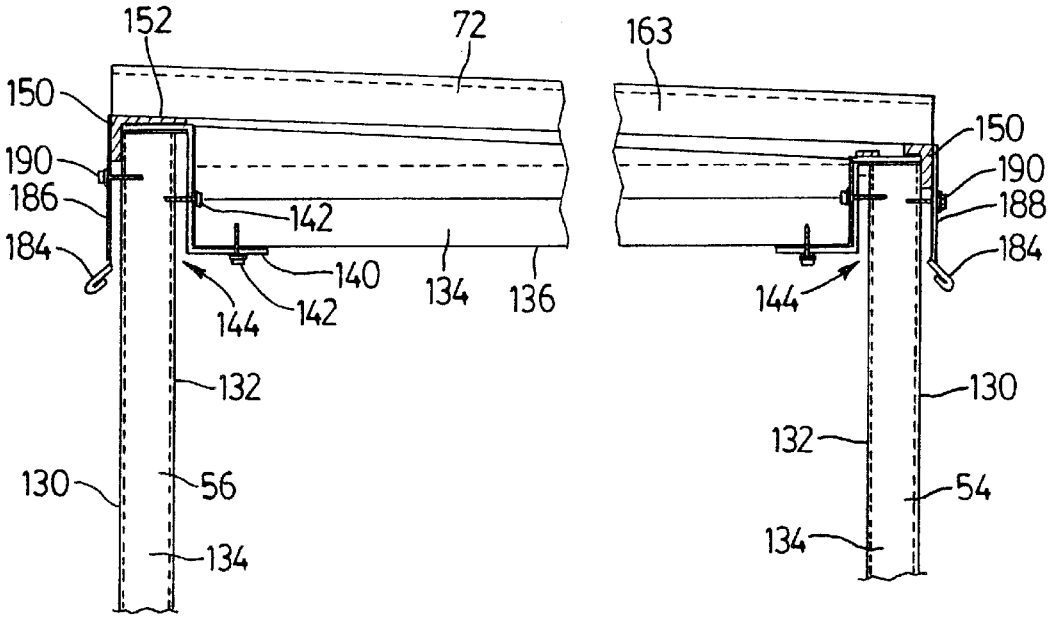
FIG. 4 is a cross-sectional elevation showing detail of the top and two longitudinal sidewalls of the preferred housing used for the air handling apparatus of FIGS. 2 and 3.

Turning now to a more detailed description of the preferred housing 72 for use in the present invention, reference will be made to FIGS. 4 and 5. The roof or top 72 of the housing can be made to slope slightly from one longitudinal side wall to the opposite sidewall as illustrated, particularly if the air handling apparatus 50 is designed for mounting on the roof of the building or otherwise to be exposed to outside weather conditions. The two longitudinal sidewalls 54, 56 and the insulated roof panels can be made a variety of thicknesses including 2 inches, 3 inches or 4 inches thick. The outer skin of each wall in a preferred embodiment is made of 18 gauge galvaneal steel sheet indicated at 130 while the inner skin of each wall and roof panel is preferably made of 22 gauge perforated galvanized steel sheet, for example, G90 steel sheet. This inner skin is indicated at 132. Between the exterior steel sheets there is a 2 inch, 3 inch or 4 inch thick layer of 1.5/3.0 lb/CFT density fibreglass insulation 134. Preferably the inner sheet 132 is painted with a tough acrylic primer coating on the side facing the air stream, this coating providing erosion resistance up to 6,000 fpm velocity. The inner skin on the roof panel is indicated at 136 and this skin is also preferably 22 gauge perforated galvanized steel sheet. The roof panels are connected to the top of the sidewall panels by means of Z-shaped sheet metal support strips 140. These Z-shaped support strips can be connected to both adjacent panels by means of self tapping Tek screws or rivets 142. The Tek screws/rivets can be spaced approximately 6 inches apart. The inside perimeter joint between the roof panels and the sidewall panels is continuously caulked at 144 with a suitable caulking compound such as Vulkem (trade-mark) water resistant compound. In order to seal the joint at the top of the sidewall and end wall panels, a foam gasket 150 can be inserted into the joint and then bent downwardly as illustrated. Butyl tape can also be used along the top of the sidewall panels at 152.

Figure 5:
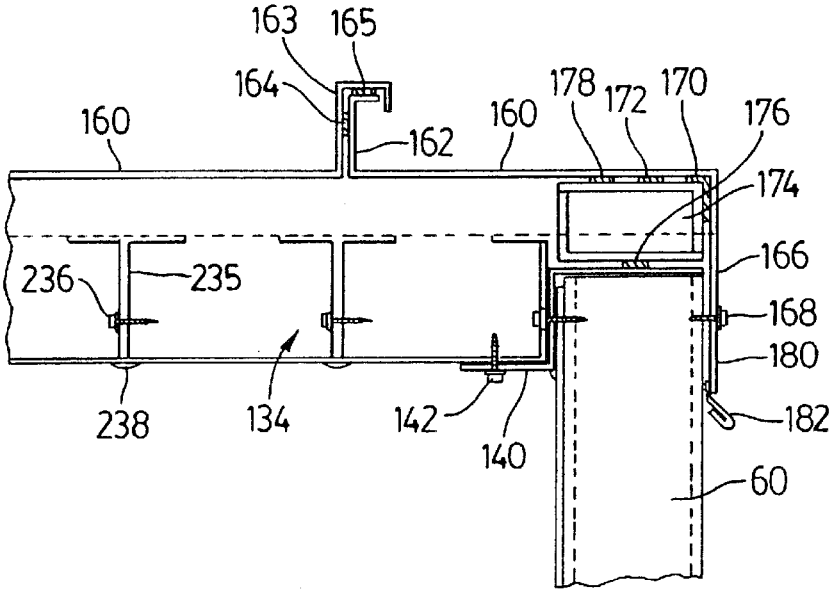
FIG. 5 is another cross-sectional elevation taken at 90 degrees to the view in FIG. 4 and showing further details of the top and one end wall of the housing.

Extending over the insulated roof panels 134 is an imperforate sheet metal exterior which can comprise a number of panels indicated at 160 in FIG. 5. When on top of the housing, these panels are connected to each other along substantially L-shaped edge flanges 162, 163. These edge flanges form roof seams or breaks and these seams can be sealed using a combination of butyl tape 164 and caulking 165. In the region of the end walls such as the end wall 60 illustrated in FIG. 5, the end roof panel 160 is bent downwardly 90 degrees to form a tapered side drop section 166. This section is secured to the outside of the end wall by means of a series of Tek screws/rivets 168. On the inside of the 90 degree bend formed by this roof panel 160 is a foam gasket 170. A bead of continuous caulking can be provided near this gasket at 172. Also in order to accommodate the sloping roof, a tapered wall block can be placed on the end wall at 174 and this block extends along the top of each of the end walls 58,60. Securing this block to the top of the end wall and sealing the joint between the block and the end wall panel is a strip of Tremco (trade-mark) tape 176. For similar reasons, Tremco tape can also be provided at 178 joining the roof panel 160 to the wall block. A rain gutter 182 can be provided along the bottom edge of each side drop section 166 and similar rain gutters 184 can be provided at the bottom edges of sheet metal roof lips 186 and 188 that extend over the foam gaskets 150. These sheet metal lips can be attached by means of Tek screws 190 and again caulking is injected between the bottom edge of each lip and the adjacent sidewall panel.

It will also be noted from FIG. 5 that the sheet metal inner skin of the roof panels is formed with inverted L-shaped edge sections 235. These edge sections extend the length of each roof panel on opposite longitudinal edges and adjacent edge sections 235 are secured together by means of Tek screws 236.

Figure 7:
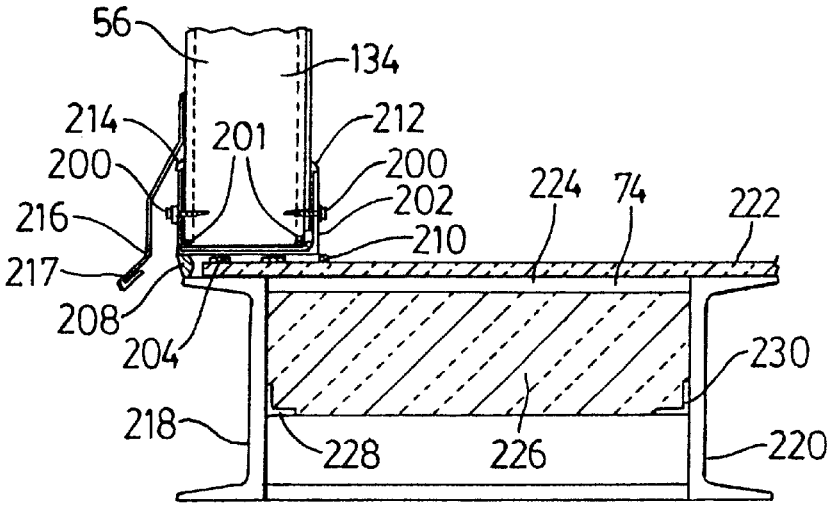
FIG. 7 is a cross-sectional elevation showing details of the preferred base of the housing and one sidewall attached thereto.

Turning now to the connection between the side wall and end wall panels and the base or floor of the housing, the preferred connection is illustrated in FIG. 7. Extending about the perimeter of the base is a U-shaped solid sheet metal channel 202. The sidewall panels are inserted into this channel and are connected thereto by means of Tek screws 200. Prior to insertion, two continuous beads of caulking 201 can be applied along the two inside corners of the channel. After the wall panels have been inserted into the channel and secured by the screws, further continuous beads of caulking can be applied along the top edges of the channel at 212 and 214. Arranged below the channel 202 are two spaced apart strips of butyl tape 204, 206 which help to seal the joint between the bottom surface of the channel and the floor. The channel is connected rigidly and permanently to the floor of the housing by means of an exterior stitch weld at 208 and an interior stitch weld 210. Also if the air handling unit is to be mounted outdoors, there is preferably a rain deflector 216 provided and this deflector extends over the outer leg of the channel as shown. The deflector can be welded to the exterior skin of the wall panel and can be provided with a small rain gutter 217.

Turning now to the preferred construction of the base or floor of the housing, the outer perimeter of the base can be formed of four inch, five inch or six inch structural steel channels, two of which are illustrated in FIG. 7 at 218, 220. A rigid framework is constructed using steel cross support members connected to the exterior channel members. Fixed to the top of the structural steel framework is floor surface 222 which is preferably made from ⅛ inch thick checkered steel plate. Located below and supporting this steel surface plate is an underneath liner 224 made of 22 gauge solid galvaneal steel. Below this liner is a layer of insulation material 226 with the preferred insulation being compressed ¾ pcf density unfaced fibreglass insulation, the thickness of which will be dependent to some extent on the thickness of the base. Suitable metal brackets 228, 230 can be connected to the inside of the structural steel framework to provide edge support for the insulation.

Figure 6:
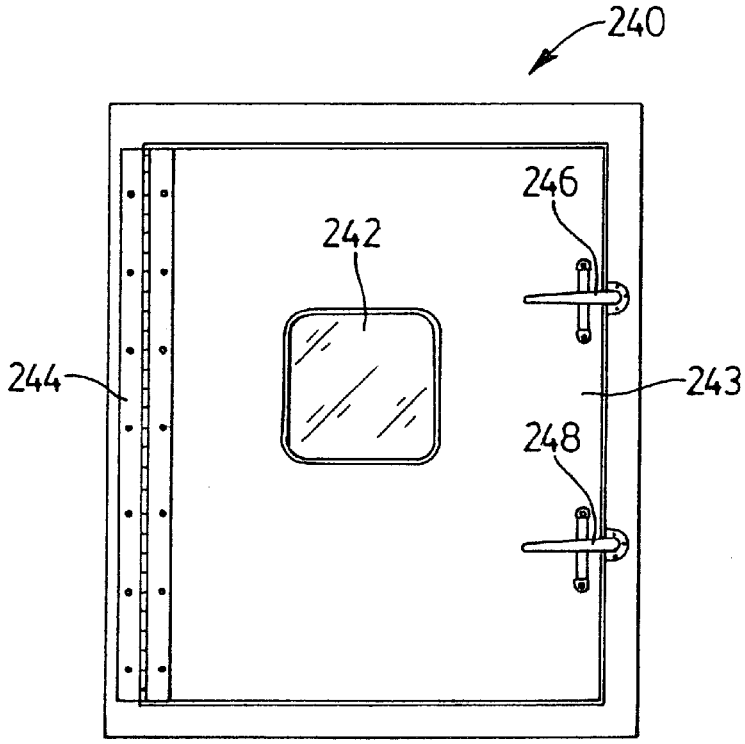
FIG. 6 is a detail exterior view of a preferred form of access door that can be mounted in a sidewall of the housing.

Turning to the preferred form of access door 240 that can be used with the present invention, a preferred door is illustrated in FIG. 6. This door 240 can be mounted in one longitudinal side of the housing as shown in FIG. 3. It will be understood that the door shown in FIG. 3 provides access for maintenance and repair personnel to the supply fan and adjoining components. Additional access doors can be mounted in the sidewalls or end walls of the housing, if desired. The illustrated door is pivotably mounted along one edge by means of a stainless steel piano hinge 244 and is connected along the opposite vertical edge by at least two Ventlok (trade-mark) VL-310 handles indicated at 246 and 248. The door can optionally be provided with a centrally located viewing window 242 which can measure 6 inches by 6 inches or larger. The viewing window can be constructed by means of two spaced apart viewing glasses mounted in a suitable gasket extending about their perimeter. The door surrounding the window is preferably insulated, the thickness of which can vary depending upon the thickness of the insulation in the adjacent sidewalls. Typically the thickness of the access door ranges between 2 inches and 4 inches. The insulation can be covered with an outer skin 243 made of a minimum 18/20 gauge galvaneal steel while the insulation is covered on the inside of the door with an inner skin preferably made of 22 gauge galvanized G90 perforated or solid sheet steel. The door can be surrounded with a sealing gasket which can be of the bulb type and the minimum width of the door is 18 inches. The door can open either inward or outward according to positive or negative pressure in the adjacent section of the housing.

Figure 8:
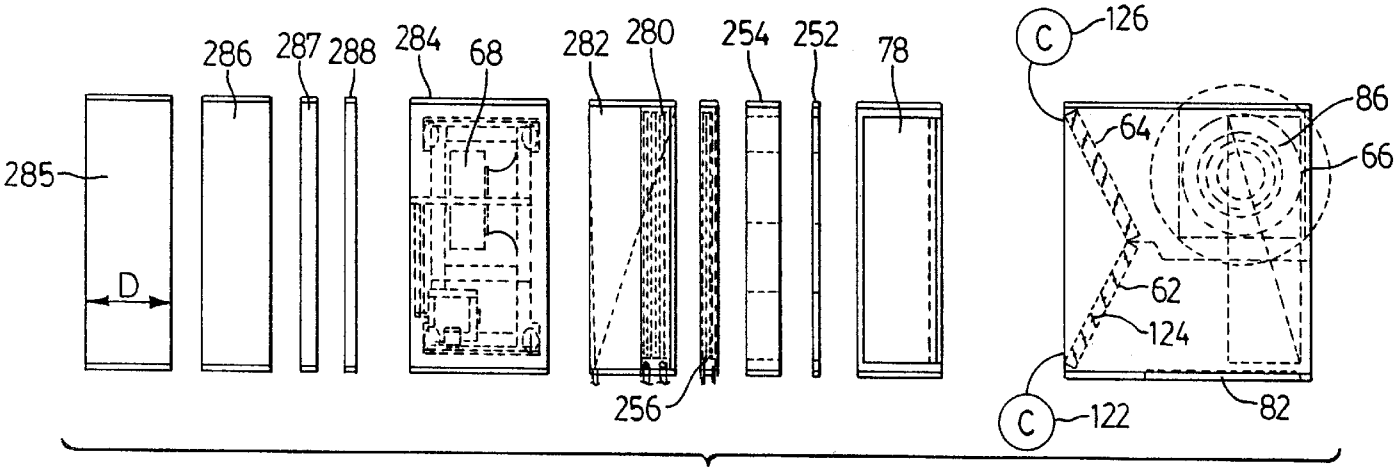
FIG. 8 is a blown-apart horizontal cross-section showing the various components and sections that together form a preferred version of the air handling apparatus of the invention.

Turning now to the various sections or components of the air handling unit as illustrated in FIGS. 8 and 9, these components or sections will be described beginning at the right hand end, that is the air inlet section and proceeding to the left end of the apparatus. The unit as illustrated is intended for outside use, for example for mounting on top of a building to which conditioned air is to be supplied. An air handling unit for indoor use in the building can be made in a similar way except for the differences noted hereinafter. Mounted on the roof at the right hand end is the aforementioned exhaust fan unit 66. Outside air enters into this right hand end through the longitudinal side wall by means of the inlet 82. Located downstream from this air inlet section and downstream of the first and second damper mechanisms 62,64 is the mixing chamber 78. Illustrated in FIG. 9 is an optional return air inlet 250 which is arranged in the top of the mixing chamber section. An additional elongate, parallel blade damper mechanism 251 can be mounted in this return air inlet. Also in the front portion of the mixing chamber there may be an additional set of parallel damper blades at 253 to provide additional control on the direction of the incoming air flow from the air inlet section. The blades of the air damper 253 extend horizontally and thus the rotation of these blades either clockwise or counterclockwise can direct the airflow either upwards or downwards as desired or as may be required by a particular installation.

Downstream of the mixing chamber and adjacent thereto is a standard layer of prefilters 252. The thickness of this layer can be 2 inches and can be made with panels having a vertical height of 20 or 24 inches arranged one above the other. The use of such prefilters is well known in the air handling industry and accordingly a further description of these prefilters herein is deemed unnecessary. Next to the prefilters is a much thicker bank of final filters 254. These final filters can have a thickness of 12 inches or more and the height of these final filters can range between 20 inches and 24 inches for each filter section or panel. Immediately downstream of the final filters there is preferably a heating coil unit 256 which can extend the full height and width of the interior space and which again can be of standard construction. A suitable heating liquid such as hot water can be pumped through the coils of this unit to heat the airflow being drawn into the supply fan. The horizontal depth of the heating coil section can be in the order of 6 inches. Directly downstream of the heating coil is a cooling coil unit 280 which can be of standard construction and which can extend the full height and width of the interior space in the housing. Preferably there is located below the cooling coil unit a drain pan 282 which can be made of 16 gauge stainless steel and which can drain into a low comer of the pan located on the downstream side of this section. The drain connection for the pan can be 1½ inch NPT. The drain pan and the surrounding areas are caulked with Vulkem 116 gun grade polyurethane sealant while other areas of the housing can be caulked using Thermoplastic Elastomeric sealant such as Tremco (trade-mark) 830 sealant.

Downstream of the cooling coil unit is the section 284 enclosing the air supply fan unit 68. The horizontal depth of this section can be as small as 32 inches. Located downstream of the air supply fan can be 2, 3 or more access sections such as the illustrated sections 285 to 288 that provide room for the air outlet. The illustrated access sections 285 to 288 vary in width depending on the particular requirements of the air handling unit. For example the depth D of the access section 285 can be 30 inches while the depth of the section 286 is 24 inches. The narrower sections 287 and 288 can, for example, be 6 inches deep and 4 inches deep respectively. It will be appreciated that the exterior of these sections are simply formed with the use of the aforementioned roof panel sections of the housing, the end wall 58, the floor and the exterior sidewalls 54, 56.

Figure 10:
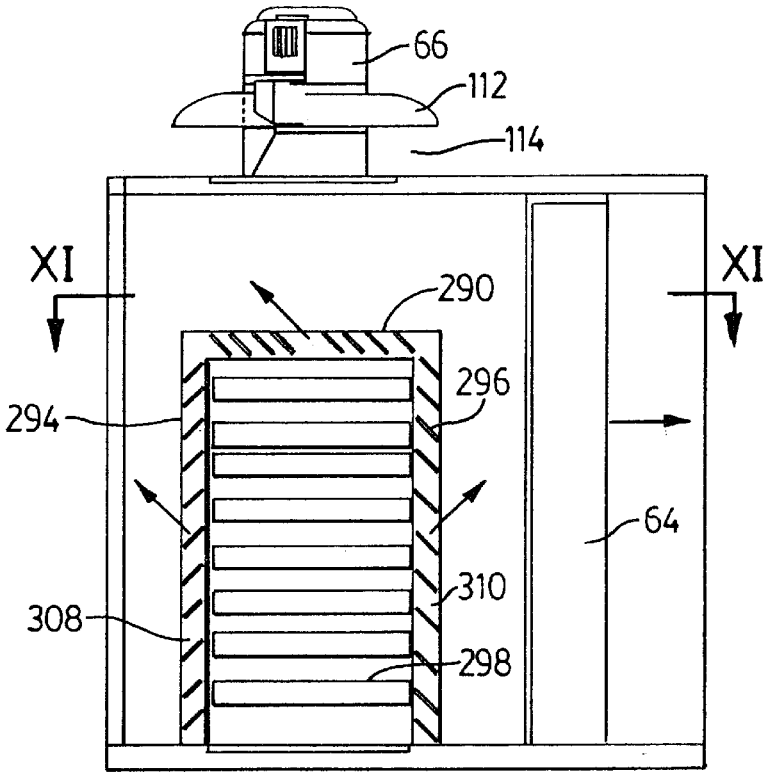
FIG. 10 is a cross-sectional elevation taken along the line X—X of FIG. 11 and showing an optional inlet silencer mounted above the air inlet for return air.

FIGS. 10 and 11 illustrate an optional but preferred silencing device that can be fitted over the return air inlet, particularly in inlet located in the floor of the housing. This special return air inlet silencer 290 has a rectangular box like configuration with a louvered top at 292 and two, three or four louvered sidewalls that extend vertically. Three of these sidewalls 294, 296, 298 are shown in FIG. 10. The vertical sidewall 298 can either be louvered as shown in FIG. 10 or can be a solid insulated wall for all or most of its height. The opposite vertical wall at 300 can also be louvered in the same manner as the illustrated wall 298. The parallel vanes or louvers 302 are preferably insulated members for increased sound attenuation. These vanes can be formed with perforated sheet metal of sufficient strength to prevent the vibration of the vanes. The vanes are connected at their opposite ends to a rigid box like framework including the horizontally extending upper frame members 304 to 307. The upper frame members are connected to vertically extending corner frames including frame members 308 and 310 shown in FIG. 10. It will be understood that the primary reason for the use of this return air inlet silencer is to prevent a direct line of sight between the return air inlet and the circular outlet over which the exhaust fan unit is mounted. The preferred use of the return air inlet silencer 290 reduces substantially the amount of fan noise from the exhaust fan that passes downwards through the return air inlet and into the return air ducts.

The preferred angle of the vanes or louvers of the silencers 290 should also be noted. The louvers in the top of this silencer slope upwardly and away from the second damper mechanism 64 as shown in FIG. 10. The louvers in the vertical walls 294 to 300 slope outwardly and downwardly. The slope of the vanes is selected in order to achieve the maximum sound attenuation from the silencer.

The above described and illustrated air handling apparatus 50 is one designed for outdoor use such as on the roof of a building. It will appreciated by those skilled in the art however that it is also possible to construct a similar air handling apparatus that is compact in size and that is intended for use inside. With an indoor unit, the first and second damper mechanism can be arranged one above the other at an obtuse angle similar to that described above. In this case the parallel damper blades or vanes extend horizontally and each can pivot above a horizontal axis. Also with this arrangement the two inlet regions at one end of the housing can be arranged one above the other. The outside air can enter, for example, through the adjacent end wall of the housing. Also with the indoor unit, the partition that separates the two inlet regions can have a horizontal section adjacent the first and second damper mechanism and then can slope upwardly towards the end wall. Most importantly with this indoor unit, the exhaust fan will usually be mounted remotely from the housing, for example, on the roof of the building and a duct will deliver the exhaust air from the upper inlet region to the exhaust fan. If desired, the return air inlet can be located in the top of the upper inlet region.

From the above description it will be appreciated by those skilled in the art that an efficient, economical and compact air handling apparatus is provided by the present invention. In particular this apparatus can be made substantially shorter in its overall length than existing known air handling apparatus serving a similar function. The apparatus can be designed to operate quietly and does not require the use of expensive duct silencers. The apparatus also offers users the option of flushing the building at peak occupancy and at desired intervals and further allows for low cost cooling and other options for variable outdoor air. With the use of the preferred first and second damper mechanisms controlling the flow of outdoor and return air into the mixing chamber, stratification can be avoided along with freeze up without the use of special, conventional blenders.

It will be readily apparent to those skilled in the art that various modifications and changes can be made to the described embodiment of the air handling apparatus of this invention without departing from the spirit and scope of this invention. Accordingly all such embodiments that fall within the scope of the appended claims are intended to be included in this invention.

I claim:

1. Air handling apparatus for blending separate air flows, said apparatus comprising;

a housing having exterior sidewalls, a top and a bottom and containing an interior space having first and second inlet regions and a mixing chamber, said housing having a first inlet for a primary air flow to pass into said first inlet region, a second inlet for a return air flow to pass into said second inlet region, and an air outlet located on a downstream side of said mixing chamber and away from the first and second inlet regions, and an internal partition in said housing separating said first and second inlet regions;

a first damper mechanism positioned between said first inlet region and said mixing chamber and capable of adjusting the amount of said primary air flow passing into said mixing chamber, said first damper mechanism comprising a first multi-blade damper and a first control mechanism for adjusting the position of the blades of the damper to open and close air gaps formed between the blades;

a second damper mechanism positioned between said second inlet region and said mixing chamber and capable of adjusting the amount of said return airflow passing into said mixing chamber, said second damper mechanism comprising a second multi-blade damper and a second control mechanism for adjusting the position of the blades of the second damper to open and close air gaps formed between the blades;

an exhaust fan unit having a fan inlet operatively connected to said second inlet region and selectively capable of exhausting at least a portion of said return air flow to atmosphere; and an air supply fan unit mounted in said housing on the downstream side of said mixing chamber and capable of drawing air from said mixing chamber and delivering same to said air outlet;

wherein said exhaust fan unit is mounted on the top of said housing inlet region.

2. Air handling apparatus according to claim 1 wherein each of said first and second multi-blade dampers comprise a series of parallel, elongate, damper blades with each blade having a longitudinal axis that extends substantially vertically.

3. Air handling apparatus according to claim 2 including a heat exchanging coil unit mounted in said housing downstream of said mixing chamber, wherein said heat exchanging coil unit extends substantially from said bottom to said top of the housing and from one exterior sidewall of the housing to an opposite exterior sidewall.

4. Air handling apparatus according to claim 3 including a bank of air filters mounted in said housing between said heat exchanging coil unit and said mixing chamber.

5. Air handling apparatus according to claim 3 wherein said first inlet is located in one of said exterior sidewalls and said internal partition includes an interior wall extending substantially from said bottom to said top of said housing and sloping upwardly and towards said second inlet region.

6. Air handling apparatus according to claim 2 wherein said first and second multi-blade dampers extend substantially in first and second vertical planes respectively when the air gaps between the respective blades are closed and wherein said first vertical plane extends at an obtuse angle taken in a horizontal plane relative to said second vertical plane.

7. Air handling apparatus according to claim 1 wherein at least said exterior sidewalls and said top of said housing are insulated with sound attenuating material.

8. Air handling apparatus according to claim 7 wherein said exterior sidewalls and said top of the housing are covered with sheet metal exterior panels and have a perforated sheet metal interior skin spaced from said exterior panels, said sound attenuating material being located between the interior skin and the exterior panels.

9. Air handling apparatus according to claim 1 wherein said second inlet for said return air flow is located at a bottom end of said second inlet region and said internal partition includes an interior wall extending substantially from said bottom of the housing to said top of the housing and sloping upwardly and towards said second inlet region.

10. Air handling apparatus according to claim 9 wherein said interior wall is insulated with sound attenuating material and has a perforated sheet metal skin on a side thereof facing said second inlet region.

11. Air handling apparatus for blending an outside air flow and a return air flow from a building or other structure, said apparatus comprising;

a housing having two longitudinally extending sidewalls, two end walls, a top, and a bottom and containing a divided air entrance section, an air mixing section, and a fan section, said housing also having a first inlet for said outside air flow to enter one aide of said air entrance section, a second inlet for said return air flow to eater another side of said air entrance section, and an air outlet located in said fan section;

first and second damper mechanisms positioned between said air entrance section and said air mixing section, each of said damper mechanisms comprising a multi-blade damper and a control mechanism for adjusting the blades of each damper to open or dose air gaps formed between the blades, said first damper mechanism being capable of controlling the outside air flow into said air mixing section and said second damper mechanism being capable of controlling the return air flow into said air mixing section;

an exhaust fan unit mounted on said top of the housing above said air entrance section and selectively capable of exhausting at least a portion of said return airflow to outside atmosphere; and an air supply fan unit mounted in said fan section which is located on a side of said air mixing section opposite said air entrance section.

12. Air handling apparatus according to claim 11 wherein said sidewalls and said end walls of said housing are insulated with sound attenuating material.

13. Air handling apparatus according to claim 11 wherein said air entrance section is divided into an outside air chamber and a return air chamber by an interior partition extending from said bottom to said top of the housing.

14. Air handling apparatus according to claim 13 wherein said interior partition is insulated with sound attenuating material and includes a sloping wall section that slopes upwardly and towards the return air chamber.

15. Air handling apparatus according to claim 14 including a heat exchanging coil unit and a filter bank mounted in said housing on a downstream side of said air mixing section which is the side located opposite the air entrance section.

16. Air handling apparatus according to claim 15 wherein each multi-blade damper extends substantially in a vertical plane when said air gaps between its respective blades are closed and said vertical plane of one of the multi-blade dampers extends at an obtuse angle to the vertical plane of the other multi-blade damper, said obtuse angle being in a horizontal plane and facing towards said air mixing section.

17. Air handling apparatus according to claim 16 wherein said obtuse angle exceeds 120 degrees.

18. Air handling apparatus according to claim 15 wherein said air supply fan unit comprises a centrifugal fan wheel and an electric motor mounted adjacent to said fan wheel and connected to a drive shaft of said fan wheel by one or more flexible drive belts.

19. Air handling apparatus according to claim 17 wherein said second inlet is located in said bottom of the housing and said sloping wall section has a perforated sheet metal skin on a side thereof facing said return air chamber.

20. Air handling apparatus for blending and conditioning separate air flows, said apparatus comprising;

a housing having exterior sidewalls, a top and a bottom, and containing an interior space that includes first and second inlet chambers, an air mixing chamber, and a fan containing chamber, said housing also having a first inlet for a primary air flow opening into said first inlet chamber, a second inlet for a return air flow opening into said second inlet chamber, and an air outlet connected to said fan containing chamber;

an internal partition mounted in said housing and separating said first and second inlet chambers;

a heat exchanging coil unit mounted in said housing on a downstream side of said air mixing chamber opposite said first and second inlet chambers;

a first multi-blade damper mechanism positioned between said first inlet chamber and said air mixing chamber and capable of adjusting amount of said primary air flow passing from said first inlet chamber into said air mixing chamber;

a second multi-blade damper mechanism positioned between said second inlet chamber and said air mixing chamber and capable of adjusting amount of said return air flow passing from said second inlet chamber into said air mixing chamber;

an exhaust fan unit connected to said housing and capable of removing said return air flow directly from said second inlet chamber; and an air supply fan unit mounted in said fan-containing chamber and adapted to deliver conditioned air from said air mixing chamber to said air outlet, wherein said first and second damper mechanisms are located at an end of said partition and are mounted on opposite sides of said partition;

wherein said exhaust fan unit is mounted on said top of said housing above said second inlet chamber.

21. Air handling apparatus according to claim 20 wherein each of said first and second damper mechanisms has a number of elongate, parallel blades that extend vertically and that are pivotable from a closed position, where the blades of the respective damper mechanism extend substantially in a vertical plane, to an open position where elongate air gaps are formed between the blades, and wherein said vertical plane defined by the blades of one damper mechanism extends at an obtuse angle to the vertical plane defined by the blades of the other damper mechanism, said obtuse angle being in a horizontal plane and facing towards said air mixing chamber.

22. Air handling apparatus according to claim 21 wherein said internal partition includes an insulated sloping wall that extends upwardly and towards said second inlet chamber.

23. Air handling apparatus according to claim 22 wherein said exhaust fan unit is mounted on said top of said housing above said second inlet chamber, said sloping wall extends substantially the height of said second inlet chamber, and said internal partition also has a vertical wall section located between said sloping wall and said first and second damper mechanisms.

* * * * *